US008408942B1

(12) United States Patent
Huang et al.

(10) Patent No.: US 8,408,942 B1
(45) Date of Patent: Apr. 2, 2013

(54) SHIELDING SHELL OF A CONNECTOR

(75) Inventors: Guang-Li Huang, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/279,285

(22) Filed: Oct. 23, 2011

(51) Int. Cl.
*H01R 13/648* (2006.01)

(52) U.S. Cl. ..... 439/607.54

(58) Field of Classification Search . 439/607.35–607.58
See application file for complete search history.

(56) References Cited

U.S. PATENT DOCUMENTS

2011/0281465 A1* 11/2011 Hou ..... 439/607.55

* cited by examiner

*Primary Examiner* — Ross Gushi
(74) *Attorney, Agent, or Firm* — Lin & Associates IP, Inc.

(57) ABSTRACT

A shielding shell includes a front shell curved from a metal plate and having a base board and two side boards, and a rear shell having a base plate of which a front edge is connected with a rear edge of the base board. Two side plates extend downward from two opposite side edges of the base plate and each is connected with a rear edge of the side board of the front shell by virtue of a strengthening structure. The strengthening structure includes a first strengthening arm extending towards the corresponding side plate from a rear edge of the side board, and a second strengthening arm extending towards the corresponding side board from a front edge of the side plate to be buckled with the first strengthening arm so as to secure the side plate and the corresponding side board together.

2 Claims, 3 Drawing Sheets

SHIELDING SHELL OF A CONNECTOR

BACKGROUND OF THE INVENTION

1. Field of the Invention

The present invention relates to a shielding shell, and more particularly to a shielding shell of a connector.

2. The Related Art

With the development of electronic technology, a connector is popularly used in our daily life. The connector generally includes a shielding shell for enclosing an insulating body together with a plurality of terminals therein. FIG. 1 shows a conventional shielding shell 200 of a connector. The shielding shell 200 includes a front shell 210 and a rear shell 220 having a base plate 221 connected with a rear edge of the front shell 210. Two side plates 222 extend upward from two opposite side edges of the base plate 221, and are located apart from two corresponding rear edges of the front shell 210. However, it weakens connection strength of the rear shell 220 and the front shell 210 on account of disconnection between the side plates 222 and the front shell 210. As a result, the shielding shell 200 is apt to deform under the action of lateral pressure. So, a shielding shell capable of overcoming the foregoing problem is required.

SUMMARY OF THE INVENTION

It is an object of the present invention to provide a shielding shell adapted for a connector. The shielding shell includes a front shell curved from a metal plate and having a base board and two opposite side boards, and a rear shell having a base plate of which a front edge is connected with a rear edge of the base board of the front shell. Two side plates extend downward from two opposite side edges of the base plate and each is connected with a rear edge of the side board of the front shell by virtue of a strengthening structure. The strengthening structure includes a first strengthening arm extending towards the corresponding side plate of the rear shell from a rear edge of the side board of the front shell, and a second strengthening arm extending towards the corresponding side board from a front edge of the side plate to be buckled with the first strengthening arm so as to secure the side plate and the corresponding side board together.

As described above, the shielding shell of the present invention utilizes the strengthening structure to simply and firmly secure the side plates of the rear shell and the side boards of the front shell together so as to strengthen the capability of the shielding shell bearing lateral pressure and further avoid a deformation of the shielding shell under the action of the lateral pressure.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
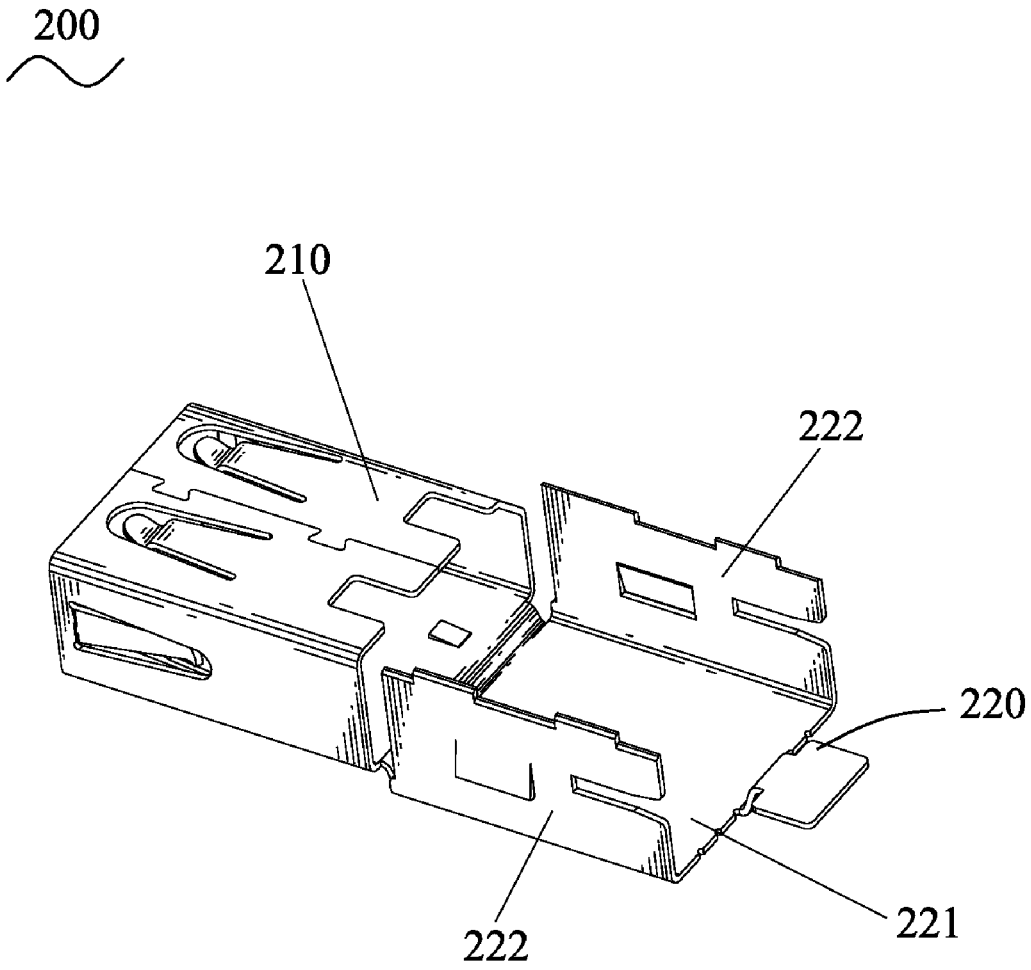
FIG. 1 is a perspective view of a conventional shielding shell of the prior art.
Figure 2:
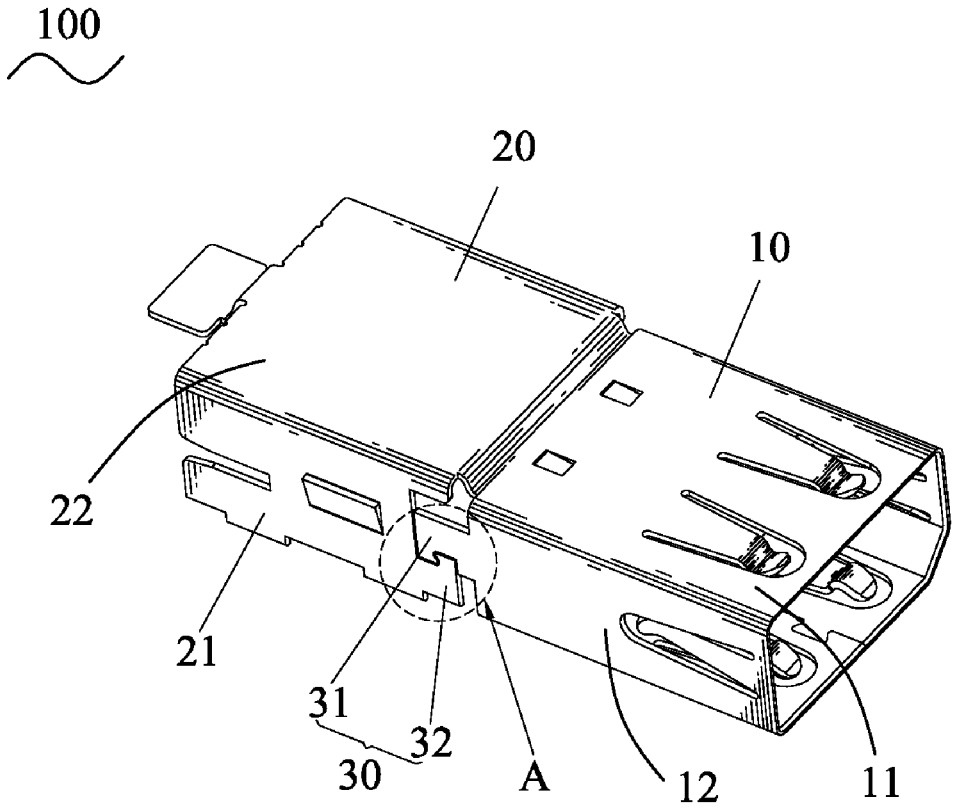
FIG. 2 is a perspective view of a shielding shell of a connector according to an embodiment of the present invention.

Referring to FIG. 2, a shielding shell 100 of a connector according to an embodiment of the present invention includes a front shell 10, a rear shell 20 connected with the front shell 10, and a strengthening structure 30 for strengthening the connection of the rear shell 20 and the front shell 10.

The front shell 10 is curved from a metal plate to substantially show a rectangular cylindrical shape, and has a base board 11 and two opposite side boards 12. The rear shell 20 has a rectangular base plate 22 of which a front edge is permanently connected with a rear edge of the base board 11 of the front shell 10, and two side plates 21 extending downward from two opposite side edges of the base plate 22 and each connected with a rear edge of the corresponding side board 12 of the front shell 10 by virtue of the strengthening structure 30.

The strengthening structure 30 includes a first strengthening arm 31 extending towards the corresponding side plate 21 of the rear shell 20 from a rear edge of the side board 12 of the front shell 10, and a second strengthening arm 32 extending towards the respective side board 12 from a front edge of the side plate 21 to be buckled with the first strengthening arm 31 so as to secure the side plate 21 and the corresponding side board 12 together. In order to economize material to reduce manufacturing cost of the shielding shell 100 and strengthen the capability of the shielding shell 100 bearing lateral pressure, in this embodiment, the first strengthening arm 31 is designed at a middle of the rear edge of the side board 12 and the second strengthening arm 32 is designed at a distal end of the front edge of the side plate 21.

Figure 3:
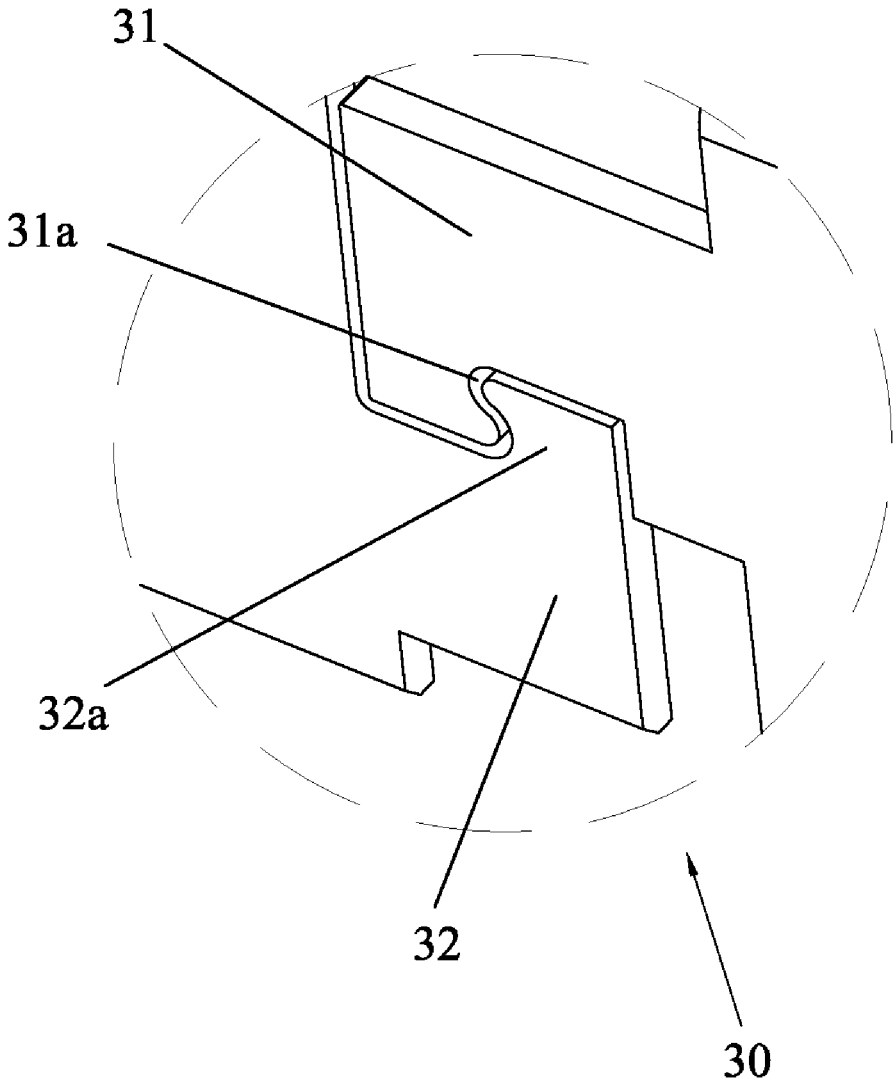
FIG. 3 is an enlarged view of a circled part A of the shielding shell of FIG. 2.

Referring to FIG. 3, a buckling fillister 31*a* is opened in the first strengthening arm 31, and accordingly, the second strengthening arm 32 defines a buckling portion 32*a* buckled in the buckling fillister 31*a* to realize a simple and firm engagement between the first strengthening arm 31 and the second strengthening arm 32. Or, the buckling fillister 31*a* also can be opened in the second strengthening arm 32, and accordingly, the buckling portion 32*a* is designed at the first strengthening arm 31 for being buckled in the buckling fillister 31*a* to realize the simple and firm engagement between the first strengthening arm 31 and the second strengthening arm 32 as well.

As described above, the shielding shell 100 of the present invention utilizes the strengthening structure 30 to simply and firmly secure the side plates 21 of the rear shell 20 and the side boards 12 of the front shell 10 together so as to strengthen the capability of the shielding shell 100 bearing lateral pressure and further avoid a deformation of the shielding shell 100 under the action of the lateral pressure.

What is claimed is:

1. A shielding shell adapted for a connector, comprising:

a front shell curved from a metal plate and having a base board and two opposite side boards; and a rear shell having a base plate of which a front edge is connected with a rear edge of the base board of the front shell, and two side plates extending downward from two opposite side edges of the base plate and each connected with a rear edge of the side board of the front shell by virtue of a strengthening structure, wherein the strengthening structure includes a first strengthening arm designed at a middle of the rear edge of the side board and extending towards the corresponding side plate of the rear shell from a rear edge of the side board of the front shell, and a second strengthening arm designed at a distal end of the front edge of the side plate and extending towards the corresponding side board from a front edge of the side plate to be buckled with the first strengthening arm so as to secure the side plate and the corresponding side board together.

2. The shielding shell as claimed in claim 1, wherein a buckling fillister is opened in the first strengthening arm of the front shell, and accordingly, the second strengthening arm of the rear shell defines a buckling portion buckled in the buckling fillister to realize a firm engagement between the first strengthening arm and the second strengthening arm.

* * * * *